US006052067A

United States Patent [19]

Nuxoll

[11] Patent Number: 6,052,067

[45] Date of Patent: Apr. 18, 2000

[54] AUTOMATED TRAFFIC CONTROL DEVICE

[76] Inventor: Randy G. Nuxoll, 2500 N. Linder Rd., Eagle, Id. 83616

[21] Appl. No.: 09/250,060

[22] Filed: Feb. 12, 1999

[51] Int. Cl.[7] ..... G08G 1/095

[52] U.S. Cl. ..... 340/908; 340/908.1; 40/606

[58] Field of Search ..... 340/908, 908.1, 340/471, 907; 116/63 R, 63 T, 173; 40/601, 606, 607, 610, 612, 418

[56] References Cited

U.S. PATENT DOCUMENTS

| | | | |
|---|---|---|---|
| 186,572 | 1/1877 | Hughson | 40/418 |
| 434,779 | 8/1890 | Herron et al. | 40/418 |
| 2,348,250 | 5/1944 | Gardner et al. | 40/418.1 |
| 2,528,962 | 11/1950 | Lieutard | 116/63 T |
| 2,610,424 | 9/1952 | Millard | 40/418 |
| 3,094,802 | 6/1963 | Perry | 340/908.1 |
| 3,213,557 | 10/1965 | Clement | 40/418 |
| 3,729,706 | 4/1973 | Hein | 349/908 |
| 3,886,519 | 5/1975 | Hovland | 340/908.1 |
| 4,777,751 | 10/1988 | Pasquale | 340/908 |
| 5,422,638 | 6/1995 | Singer et al. | 340/908.1 |
| 5,603,177 | 2/1997 | Saunders | 40/418 |
| 5,703,577 | 12/1997 | Carter | 340/908 |
| 5,755,051 | 5/1998 | Zumbuhl | 340/908 |

*Primary Examiner*—Daniel J. Wu
*Assistant Examiner*—Van T. Trieu
*Attorney, Agent, or Firm*—Robert L. Shaver

[57] ABSTRACT

A traffic control device with folding legs which form a sawhorse type base when extended, and which fold for storage. The traffic control device has wheels which come into contact with the road surface when the frame of the traffic control device is lifted at one end. Attached to the traffic control device is a simulated flagman which has a head, a torso and an arm. The arm supports a two-sided traffic control sign. The sign is placed in a sign holder of the simulated flagman, and a motor turns the sign 180 degrees in either direction to expose one side or the other of the traffic control sign. The motor is controlled by a wireless remote transmitter and receiver. The device can be operated by a flagman, allowing the flagman to be situated in a position of safety from the traffic. One or a pair of these devices can replace one or two flagmen in controlling traffic.

15 Claims, 9 Drawing Sheets

AUTOMATED TRAFFIC CONTROL DEVICE

BACKGROUND OF THE INVENTION

1. Field of the Invention

The present invention generally relates to traffic control devices, and more particularly to automated remote controlled traffic control devices.

2. Background Information

There are numerous situations in which traffic on a roadway needs to be controlled or directed. In some of these situations, a flagman is currently used to display a sign which may say STOP on one side and SLOW on another side. Other situations may require the display of a sign which indicates that a parking lot is full, or there is only parking available for monthly permit holders. One common need for traffic control by flagmen with a sign is when construction projects are being performed on a roadway or adjacent to a roadway. If construction equipment needs to cross a roadway in such a situation, or needs to enter traffic from off the roadway, a flagman or a pair of flagmen stops traffic. With the traffic stopped, the construction vehicles cross the roadway or enter the flow of traffic. Once the construction vehicle has crossed the roadway or has entered traffic, the flagmen on either side allow the stopped traffic to proceed.

This situation can be dangerous for all of those involved, including motorists, flagmen and the drivers of construction vehicles. It is also expensive for the construction project to have workers whose only job is to hold a sign which informs motorists to stop or go. It is not uncommon for flagmen to be hit by traffic. It is also not uncommon for motorists to be involved in collisions with construction vehicles. A device which addresses the shortcomings of the current practice is needed.

Accordingly, it is an object of the invention to provide a traffic control device which can be controlled remotely, and which replaces a human flagmen. It is a further object of the invention to provide a remote control traffic control device which holds interchangeable signs, each of which can be rotated 180° to alternately display either side of the sign.

Another object of the invention is to provide a traffic control device which uses a simulated flagman. It is an object that the simulated flagman can be interchangeable with replacement simulated flagmen. It is a further object of the invention that the simulated flagmen can be of a style which is likely to catch the attention of a motorist and cause him to take notice of the message being displayed on the sign held by the simulated flagman. It is a further object of the invention that the traffic control device be compact in design, and be easy to transport, so that multiple units can be carried in a pickup truck. It is a further object of the invention that the traffic control device be operated with a power source which can be charged by a 12-volt automotive charging system.

It is a further object of the invention that the traffic control device be controllable in a variety of ways. This can include by a timer which causes the sign to rotate at selected time intervals. It can also be controlled by a remote control device, and by a wireless remote control transmitter. It is a further object of the invention that the traffic control device operates from an electronic transmitter which has no power drain except when transmitting a signal, to save energy, and to allow for a smaller battery and a longer life of the battery.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

These and other objects and advantages are attained by a traffic control device which can be used in a variety of vehicular traffic situations, including along a roadway, at the entrance to a parking lot, bordering a work site, at the entrance to a facility, or in a number of similar traffic situations. The traffic control device of the invention can be mounted on one or more legs and it is important that these legs be configured to resist deflection of the traffic control device by the wind. When positioned along a roadway, any kind of sign or sign holding device can be subject to significant pressure from the wind, or wind created by large trucks passing by at high speed. A traffic control device with a small surface area exposed to the wind, and with adequate means to resist sliding, rolling and tipping over is essential.

Included as part of the device is a simulated flagman which is mounted to the legs of the device. The simulated flagman is designed to be observable by a motorist and to attract the attention of the motorist. This is accomplished by the simulated flagman being an interesting and unusual figure. It could be a torso with a jack-o-lantern, or a realistic human head, or it could be made to resemble a cartoon caricature, such as a giant lizard, celebrity figures, or caricatures of construction workers, flagmen, or other people.

The traffic control device also includes a sign holder, which is attached to and part of the simulated flagman. The sign holder is for holding a two-sided traffic control sign, such as one which says STOP on one side and SLOW on the other side. The sign holder displays one side of the traffic control sign to oncoming traffic, and upon a signal, rotates the sign 180° to display the opposite side of the sign to oncoming traffic.

The device also includes a motor, for rotating the two sides traffic control sign.

The device also includes a two-sided traffic control sign, which can include a number of messages or instructions. The two sides of the sign can say STOP on one side and SLOW on another side. It can also say PARKING LOT FULL on one side, and PARKING FOR MONTHLY PERMIT HOLDERS ONLY on the other side. A number of other messages are possible, depending upon the traffic control situation in which the traffic control device is used. Besides stopping, slowing or directing traffic, the sign can convey information to motorists, such as "Proceed to Parking Lot B", or "Parking for Concert Goers Only."

The traffic control device also includes one or more weights, which are attached to the device and can be removable from the device. By making the weights removable, the unweighted device can be more easily loaded and transported. When on the job site, the weights can be added to help the traffic control device be more stable in the wind. If mounted on the lower part of the legs, the weight keeps the device's center of gravity low, and resists tipping.

The traffic control device includes a control means for actuating the motor and the flag holder. The control means thus causes the motor to rotate the flag holder and the traffic sign 180° to display the opposite side of the sign to oncoming motorists.

The traffic control device also includes a power source, which supplies power to the motor, and the other components.

The traffic control device can utilize a control means which is a timer. The timer would be set to activate the sign holder at selected time intervals. This would be useful if traffic is to be stopped periodically to allow construction vehicles onto the roadway, or other situations in which traffic is to be periodically stopped, diverted, or otherwise controlled. The traffic control device can also utilize a control means which is a remote control which is manually triggered to activate rotation of the sign holder. This could be accomplished by an operator standing back from the roadway, possibly operating two traffic control devices which alternately show "STOP" to motorists from one direction, and "SLOW" to motorists from the other direction. Control could also be accomplished by the driver of a construction vehicle who wishes to enter the flow of traffic and utilizes the traffic control device to momentarily stop the flow of traffic to allow him to do so. The control means can be wireless, and utilize radio control to activate the sign holder. If wireless, the driver would activate the traffic control device to stop traffic, enter the flow of traffic, or cross the roadway, and then either activate the traffic control device to allow traffic flow to resume, or have a timer do so. A wireless remote would include a transmitter and a receiver.

One version of the traffic control device utilizes a simulated flagman which rotates into a storage position. This position can be with the simulated flagman situated in an upside-down position, with the legs of the device folded around it. The traffic control device can also include a video camera which can be configured to view, transmit and record images of the vicinity of the traffic control device. The purpose of the video camera would be two fold. First, the video camera could record images and let a person at a remote location see what the conditions are in the vicinity of the traffic control device. Second, the presence of a video camera would tend to make a motorist think twice about disobeying the directions given by the traffic sign. The motorist might wonder if images from the video camera might be recorded and used to give him a fine at a later date, or might be transmitted to a monitor with the authority to write traffic citations. With these possible outcomes, the mere presence of a video camera could increase compliance with the traffic signs displayed by the traffic control device. For this reason, a simulated video camera could also have the effect of increasing compliance with the traffic control device sign.

In one version of the traffic control device, the legs take the form of a support frame, which is similar in configuration to a sawhorse. The support frame includes two rectangular planar frames, called a first and a second rectangular planar frame. Each rectangular planar frame has a front side, a rear side, a top side, and a bottom side. The intersections of these four sides form four corners on each rectangular planar frame. The two rectangular planar frames are joined by one or more hinges along the top edge of each. The bottom sides of each of the rectangular planar frames form road surface contact regions, and rest against the road surface.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
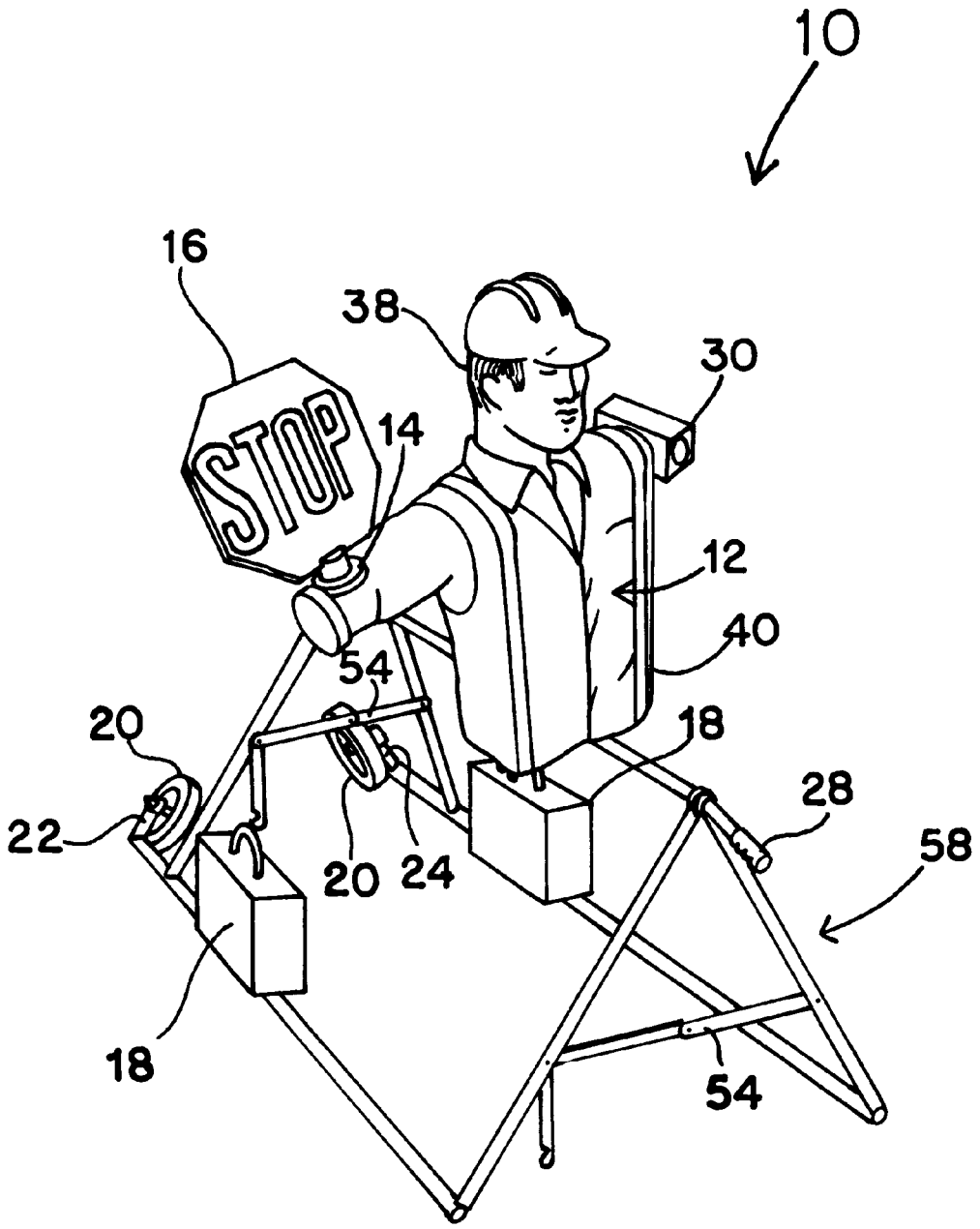
FIG. 1 is a perspective view of the traffic control device in an operational mode and in an operational position.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

FIGS. 1 through 9 show a preferred embodiment of the invention. As shown in FIG. 1, the traffic control device 10 includes a simulated flagman 12. Attached to the simulated flagman 12 is a sign holder 14. A two-sided traffic control sign 16 is inserted into the sign holder 14. The simulated flagman 12 is attached to the frame 58, and may rotate about the frame 58.

Figure 2:
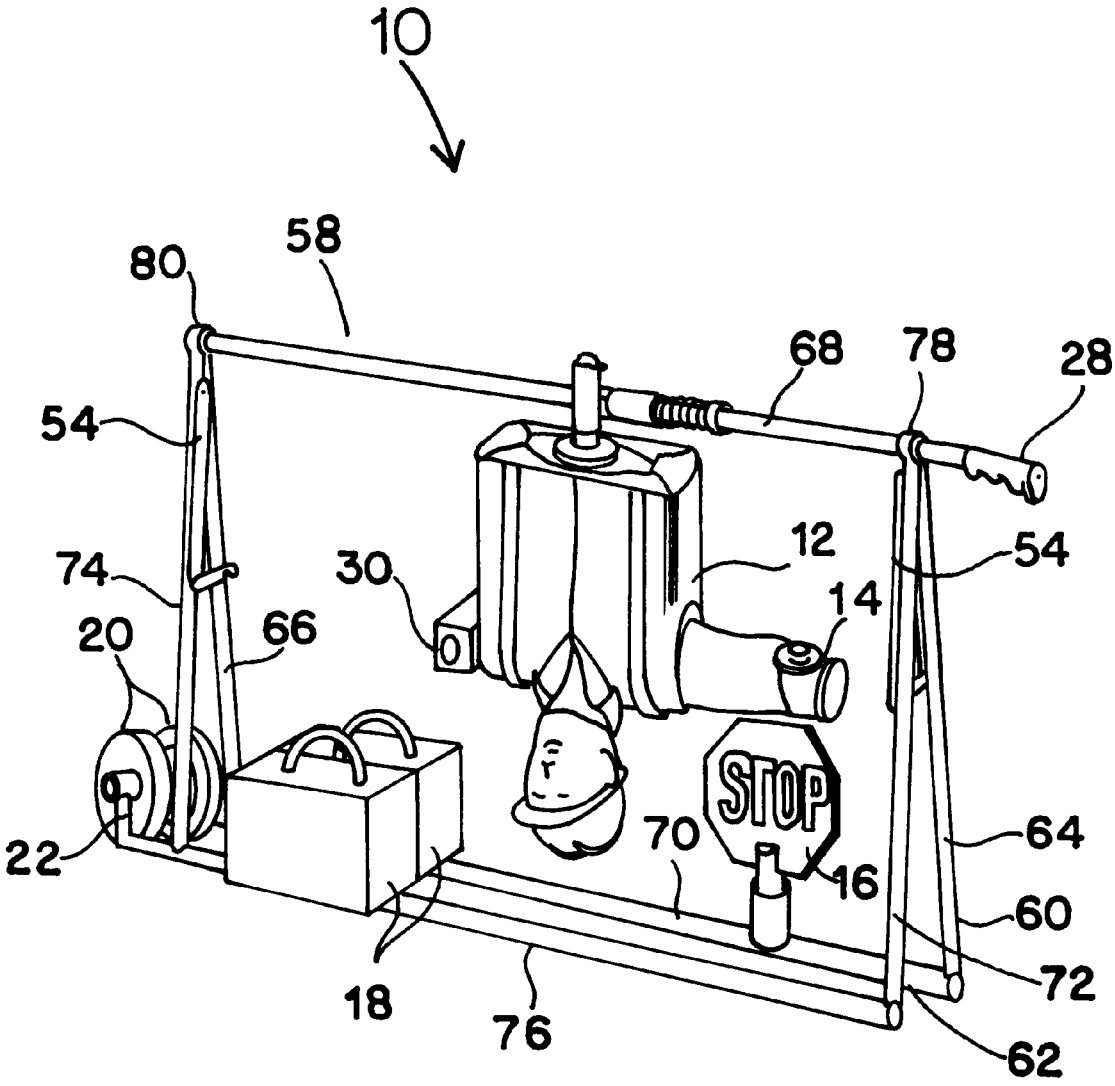
FIG. 2 is a perspective view of the traffic control device with the flagman rotated around the frame, and the frame folded into a transport position.

Although the frame can be a number of configurations, with one or more legs, in this particular preferred embodiment the legs are comprised of the frame 58. The frame 58 in this embodiment is configurable to two positions. An operational position is shown in FIG. 1, and a transport position is shown in FIG. 2. In the transport position, the traffic control device 10 can be moved by lifting up on a handle 28 attached to the frame 58. When the frame 58 is lifted at one end by lifting the handle 28, wheels 20 come into contact with the road surface, making the traffic control device 10 mobile. In this position, the traffic control device 10 can be wheeled along a roadway to a pickup or trailer, and wheeled up a ramp or lifted into the pickup or trailer for further transport or storage.

The frame 58 of the embodiment shown in the drawings comprises a first rectangular planar frame 60 and a second rectangular planar frame 62. In this embodiment the frame is made of ¾ inch tubular black steel, but the invention could just as easily be made of square tubing, angle steel, or other cross sectional shapes or materials, such as plastic.

The details of the frame 58 are best seen in FIG. 2. The first rectangular planar frame 60 includes a front side 64, a rear side 66, a top side 68, and a bottom side 70. The second rectangular planar frame 62 is composed of similar members, including a front side 72, a rear side 74, and a bottom side 76. In this embodiment, the second rectangular planar frame 62 does not have a top side corresponding to the top side 68. Instead, the front side 72 and the rear side 74 are joined to the top side 68 by a first hinge 78 and a second hinge 80. The first hinge 78 and second hinge 80 in this embodiment are rings which are attached to the end of front side 72 and rear side 74. These rings encircle the top side 68. In other configurations of the device, the second rectangular planar frame could also have a top side corresponding to top side 68. A number of different configurations of hinges could also be utilized. The significance of the hinges is that the first rectangular planar frame 60 and the second rectangular planar frame 62 can rotate toward or away from each other around the first and second hinge 78 and 80. By rotating away from each other, they place the frame 58 in an operational position, as shown in FIG. 1. By rotating toward each other, they place the frame 58 in a transport position, as shown in FIG. 2.

Attached to the frame 58 is a first wheel bracket 22 and a second wheel bracket 24. To each of these wheel brackets is attached a wheel 20, which is preferably 12 inches in diameter. To one or both ends of the frame 58 is attached a brace 54, which limits the distance that the first rectangular planar frame 60 and the second rectangular planar frame 62 can move away from each other, as shown in FIG. 2. The brace 54 folds in the middle when the two rectangular planar frames rotate toward each other toward a transport position, as shown in FIG. 2.

Attached to frame 58 are a pair of weights 18. Although the weights 18 can take on a variety of shapes, in the preferred embodiment the weights 18 are formed of concrete, which is poured into a rectangular mold in which is placed a weight handle 82. The weight 18 is approximately 5 inches by 6¾ inches by 10½ inches. In the preferred embodiment, weight handle 82 is a tough, flexible plastic conduit, such as ½ inch Weathertite®, made by Alflex. Once the concrete hardens, the conduit which forms the weight handle 82 is locked in place in the conduit, and by its hollow nature provides two tubular openings through the otherwise solid block of concrete. These tubular openings 84 interfit with corresponding frame projections 86, which are attached to a bottom side 76 of the second rectangular planar frame 62, and the bottom side 70 of the first rectangular planar frame 60. By this configuration, the weights 18 can be set in place on the frame 58 by placing the tubular openings 84 over the frame projections 86. The traffic control device 10 can be dismantled for transport by removal of the weights 18 from the frame 58.

Figure 3:
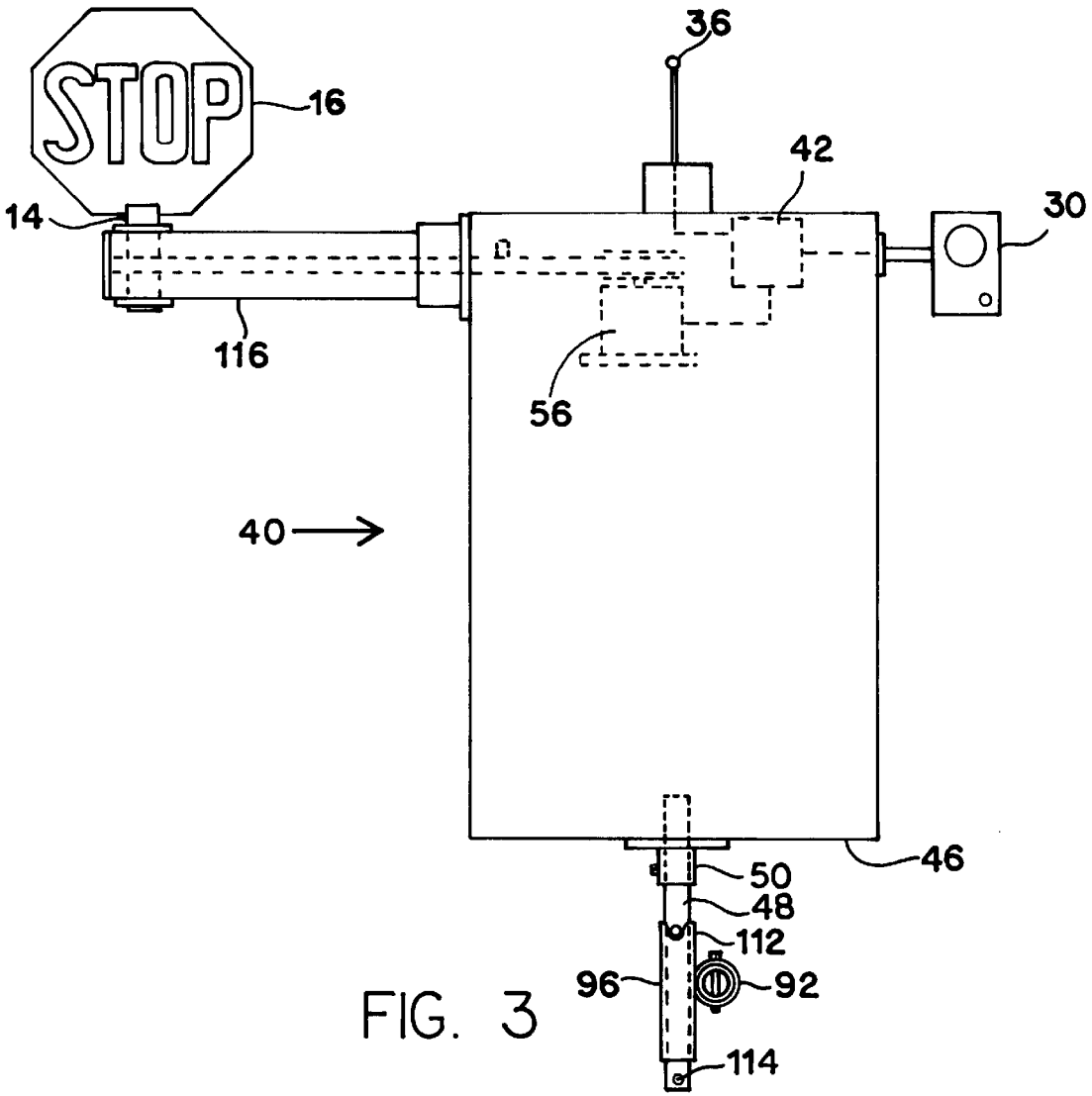
FIG. 3 is a front view of the torso of the flagman, showing the mechanical portions of the device.
Figure 6:
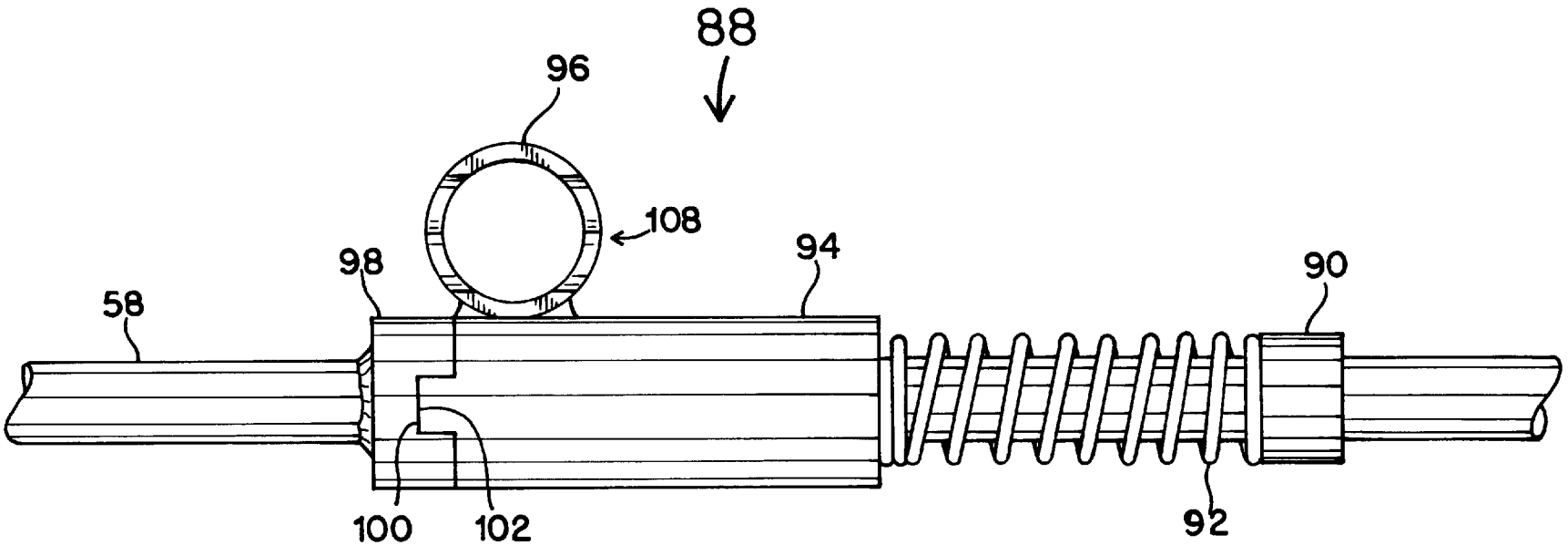
FIG. 6 is a top view of the flagman positioning collar.
Figure 7:
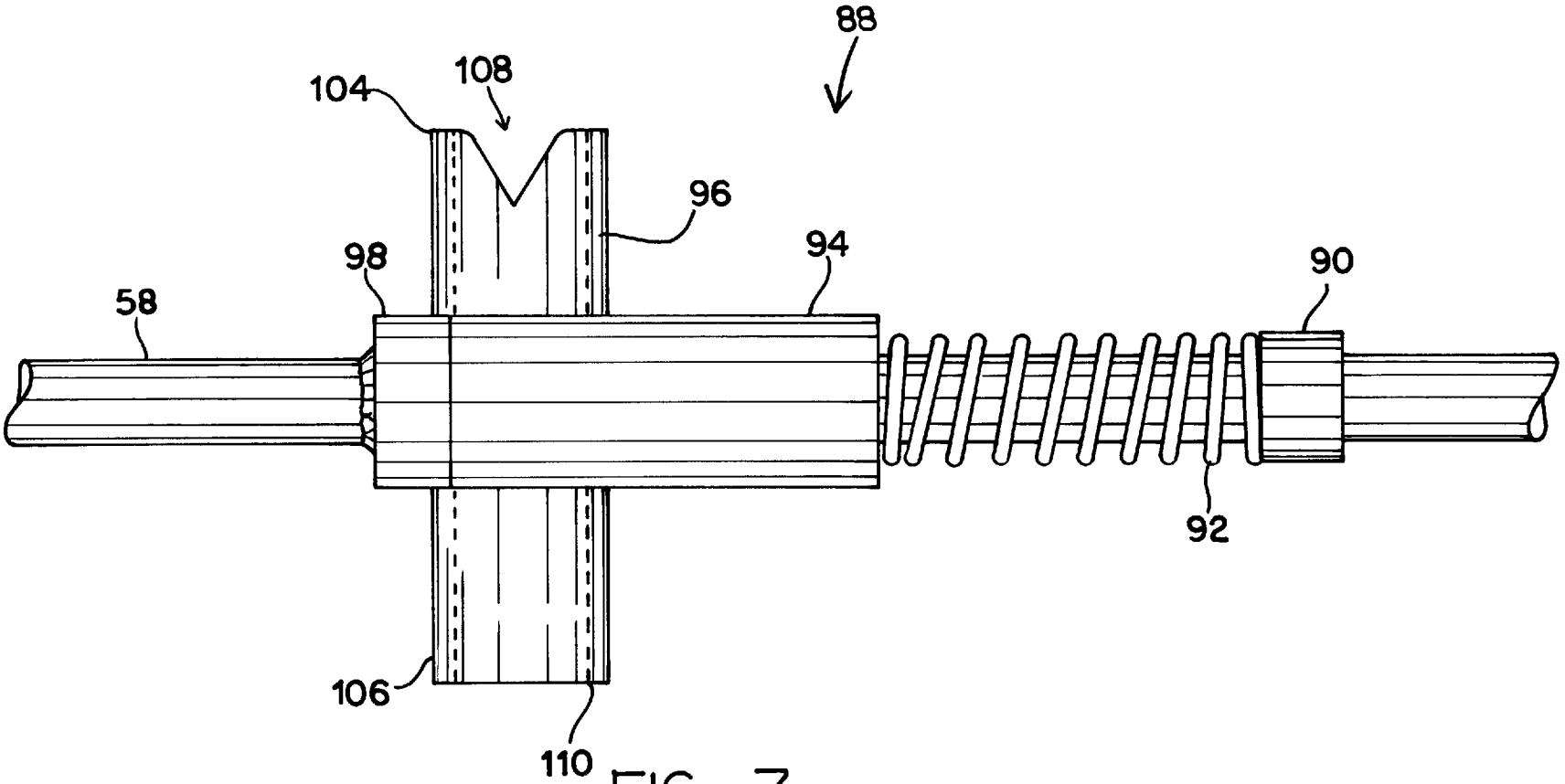
FIG. 7 is a side view of the flagman positioning collar.
Figure 8:
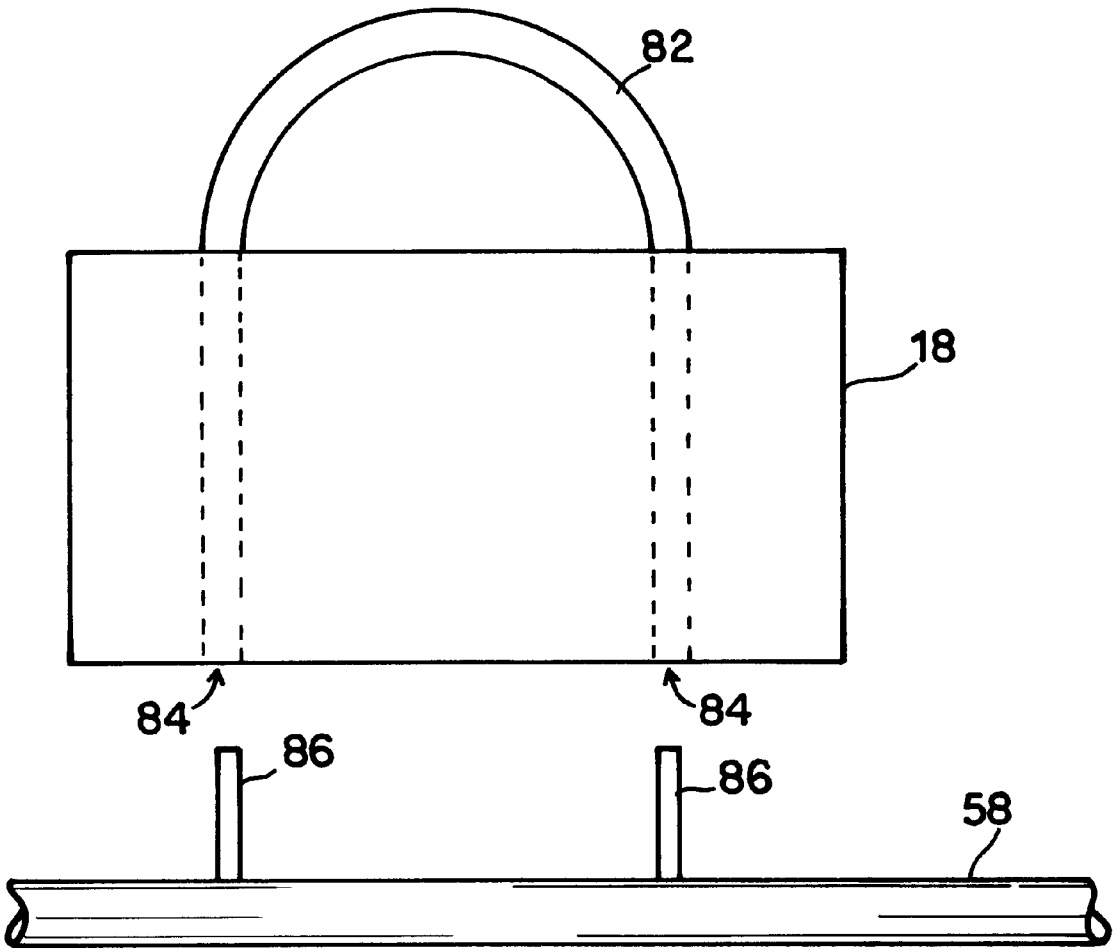
FIG. 8 is a side view of the weights and part of the frame on which the weights are attached.

The simulated flagman 12 is attachable to the frame 58 in a variety of configurations, but the specific manner of attachment of the preferred embodiment is shown in FIGS. 3, 6 and 7. The simulated flagman 12 is shown in these drawings to be attached to the frame 58 by the use of a flagman positioning assembly 88. The flagman positioning assembly 88 includes a first stop ring 90, a spring 92, a gripping collar 94, a sign tube 96 and a second stop ring 98. The first stop ring 90 is a locking collar which is releasably secured around the top bar of the frame 58. The first stop ring 90 can be positioned by the use of set screws or other friction locking devices. It can be released, for removal from the frame 58. Spring 92 is preferably a steel spring approximately 4 inches in length, which fits around the top side of frame 58. It is positioned between the first stop ring 90 and the gripping collar 94, as shown in FIGS. 6 and 7. The second stop ring 98 is preferably fixed to the frame 58 by welding. It is a generally circular section of pipe which fits around the tubular steel pipe of frame 58. It has a detent notch 100, which is best seen in FIG. 6. The gripping collar 94 is also a tubular section of steel pipe which fits around the tubular pipe of frame 58. The gripping collar 94 has a detent tab 102, as shown in FIG. 6. By gripping the gripping collar 94 and pulling it towards the first stop ring 90, thereby compressing the spring 92, the detent tab 102 can be disengaged from the detent notch 100, and the gripping tube 94 can be rotated around the frame 58.

Attached to the gripping collar 94 is a flagman tube 96. Flagman tube 96 is a 4 inch long tubular section of steel which is preferably welded to the gripping collar 94. Flagman tube 96 has a first end 104 and a second end 106. At the first end 104 of flagman tube 96 is located a flagman orienting notch 108. Flagman orienting notch 108 is a generally V-shaped notch, cut into the walls of the flagman tube 96. The notch 108 is cut into the flagman tube 96, so that a line between the bottom of the V's in the two sidewalls in which the V's are cut would form a line which is normal to the long axis of the frame 58. The second end 106 of the flagman tube 96 also has an orienting notch 110. Orienting notch 110 is comprised of two V-shaped notches cut into the side walls of the flagman tube 96, just like orienting notch 108. However, orienting notch 110 is positioned normal to orienting notch 108, and parallel to the frame.

Flagman tube 96 is designed to hold a flagman post 48, as best seen in FIG. 3. Flagman post 48 is a ¾ inch steel pipe which fits inside flagman tube 96. Flagman post 48 has an upper pin 112 and a lower pin 114. Flagman post 48 is attached to a flange 50, which itself is attached to the base 46 of the flagman torso 40. Upper pin 112 is oriented to be normal to the flagman arm 116. Lower pin 114 is configured to be parallel to upper bolt 112. When the flagman 12 is in an upright operational position, as shown in FIGS. 1 and 3, the weight of the flagman 12 presses down on the upper pin 112, causing it to orient itself by gravity into the lowest portion of orienting notch 108. When in this position, the flagman is automatically oriented so that his "shoulders" are normal to the longitudinal axis of the frame 58. This position is shown in FIG. 1.

From the operational position shown in FIG. 1, the gripping collar 94 can be pulled toward the first stop ring 90, and the flagman tube 96 and the flagman 12 can be rotated 180° around frame 58. Once rotated into the position shown in FIG. 2, the upper pin 112 is pulled out of the orienting notch 108 by gravity, and the lower pin 114 is pulled into contact with the flagman tube 96. Due to the perpendicular arrangement between the two notches, when the flagman is upside down as shown in FIG. 2, the weight of the flagman will cause the flagman to rotate 90 degrees, until the lower bolt 114 rests in the deepest part of the orienting notch 110. When lower bolt 114 is fully seated in the orienting notch 110, the "shoulders" of the torso of the flagman 12 is oriented parallel with the frame 58, as shown in FIG. 2.

Figure 4:
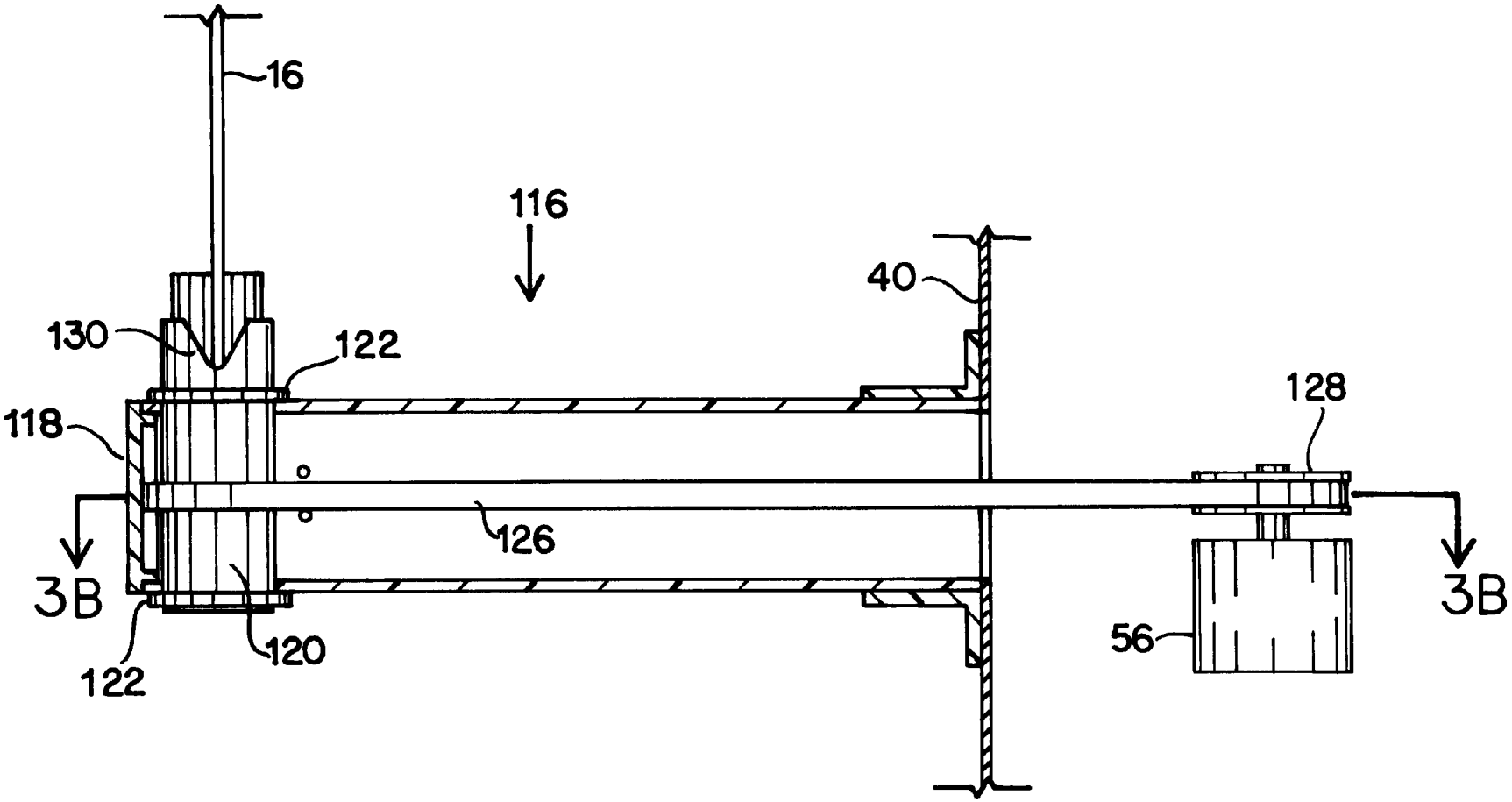
FIG. 4 is a front cut-away view of the arm of the flagman showing the drive mechanism for turning the flag.
Figure 5:
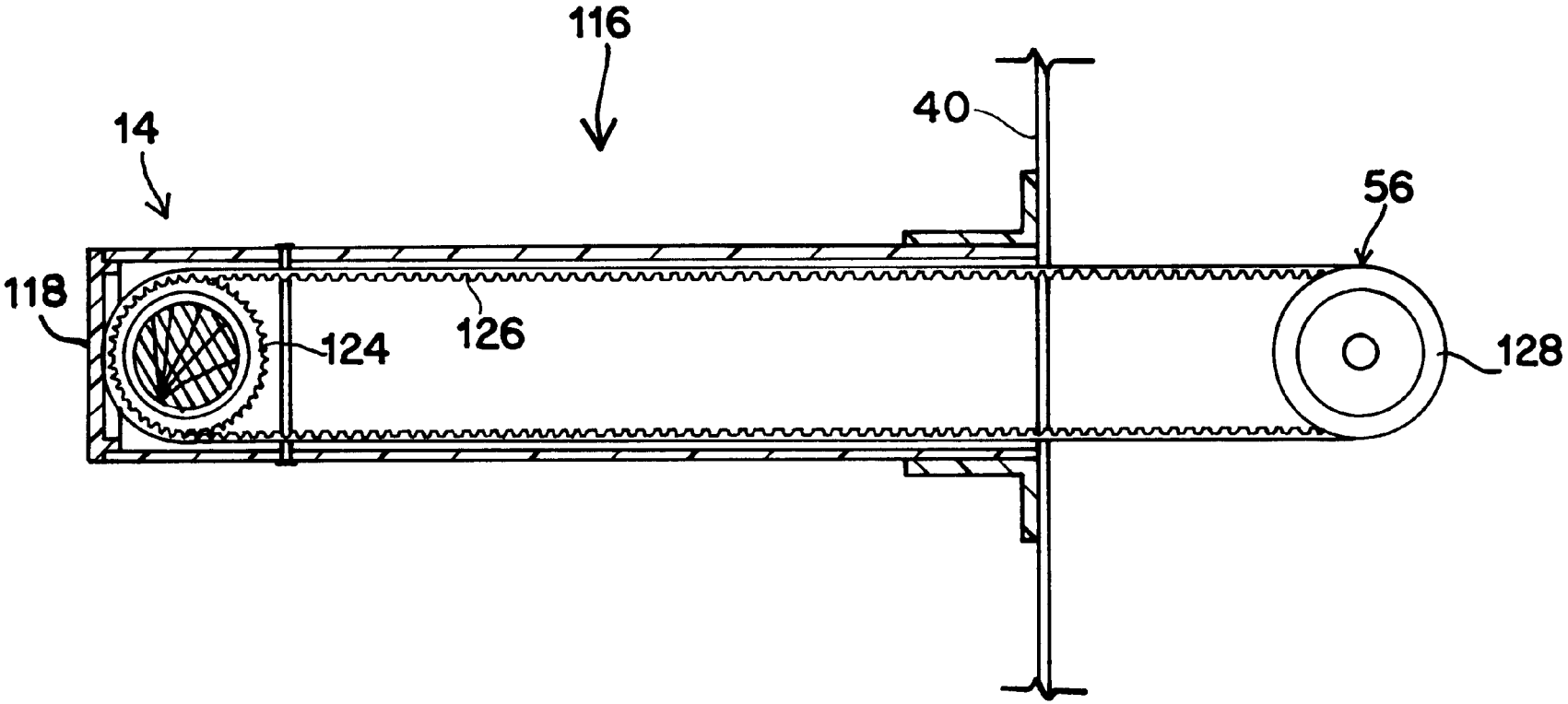
FIG. 5 is a top cut-away view of the same arm of the flagman showing the mechanical drive for the sign rotator.

Shown in FIGS. 4 and 5 are the internal components of the flagman arm 116. The flagman arm is a 3 inch PVC pipe, approximately 12 inches long, with a cap 118 closing the end. At the distal end of the flagman arm 116 is mounted a flag tube 120. Flag tube 120 is a 1 inch tube made of steel which extends through and is anchored in the sidewall of the flagman arm 116, by locking collars 122 ½ inch thick. Mounted centrally on flag tube 120 is a flag tube pulley 124. A belt 126 extends around the flag tube pulley 124, and around a motor pulley 128. Motor pulley 128 is attached by a shaft to motor 56. The belt 126 extends through a hole in the torso 40 of the simulated flagman 12 and in the preferred embodiment is a 40 inch long belt with teeth. In the preferred embodiment, motor pulley 128 has 42 teeth, and flag tube pulley 124 has 40 teeth, so that a 170 degree rotation of motor pulley 128 results in a 180 degree rotation of flag tube pulley 124.

Flag Tube 120 also has an orienting notch 130. Traffic sign 16 is placed in flag tube 120 so that the edges of the traffic sign 16 are centered in the orienting notch 130. Thus, when motor 56 turns motor pulley 128 170° in either direction, flag tube 120 turns 180° in either direction, and exposes one side or the other of traffic sign 16 to oncoming traffic.

Figure 9:
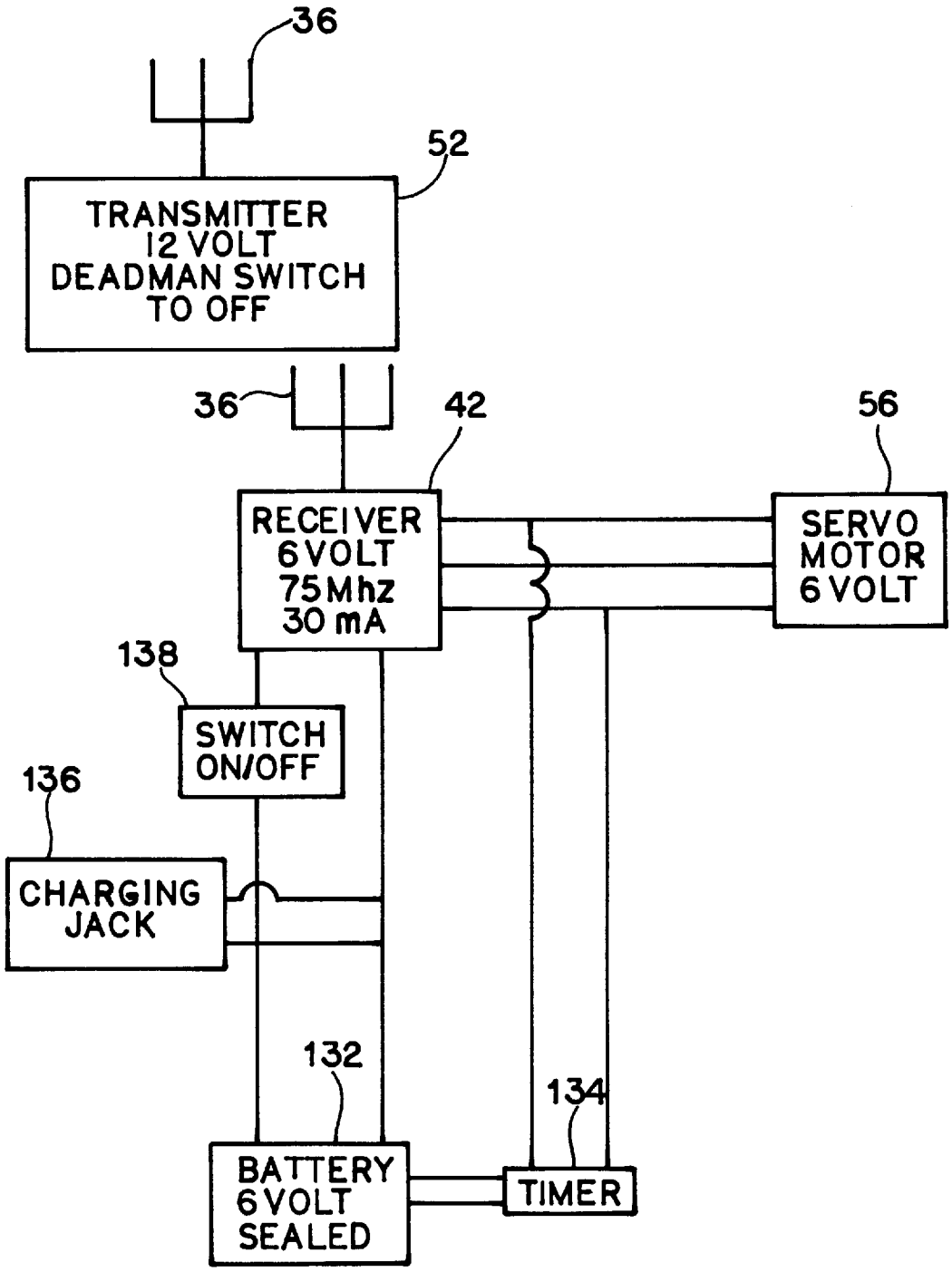
FIG. 9 is a diagrammatic view of the electronics of the device.

FIG. 9 shows a diagrammatic view of the electronics of the device. The electronics include a 12 volt transmitter. In the preferred embodiment, the transmitter is a 2 PC Magnum Sport transmitter, made by Futaba. The transmitter is modified so that it is not energized, and there is no power draw until a sending trigger is actuated. The sending trigger has two directions of throw. Pressing the sending trigger in one direction will cause the sign to rotate 180 degrees in one direction. Repeatedly pressing the sending trigger in that direction will not result in any more than one 180 degree rotation. Depressing the sending trigger in the other direction will cause the sign to rotate 180 degrees in the other direction. Repeatedly pressing the sending trigger in the second direction will not cause the sign to rotate again until it has first rotated in the opposite direction. The transmitter 52 includes an antennae 36. The receiver 42 also includes an antennae 36. The receiver 42 is a radio receiver with 30 ma draw. The receiver used in the first embodiment is a FP-R122JE made by Futaba. The receiver 42 is powered by a 6-volt sealed battery 132. When activated by the transmitter, power from the battery operates a 6-volt servo motor 56. The servo motor is a sail winch designed to turn only 60° degrees, but modified to turn 180°. The servo motor of the preferred embodiment is a part number S 550 servo sold by FMA Direct. A timer 134 is also included. When the timer 134 is utilized, it can be set so that the servo motor is activated at a selected time interval, and rotates 180 degrees at each time interval. A charging jack 136 is also included in the system, and is used to charge the battery 132. A video camera 30 is an optional component of the system, and is preferably not connected to the electrical system of the servo motor. The video camera can utilize conventional technology and either record images within the video camera, or transmit them to another location for viewing or recording. The device also includes a switch 138 for turning the system on or off.

In operation, the traffic control device would be placed along side a roadway where a flagman would normally stand. Two of these devices could be operated by one flagman, who would then be himself situated in an off-roadway vantage point, where he is safe from traffic. One flagman in such a position could observe the flow of traffic, and change the message displayed by each traffic control device 10, as required by the situation. In another application of the device, a traffic control device 10 could be placed in traffic where construction equipment needs to enter the flow of traffic. Each operator of a piece of construction equipment would have a transmitter 52, and when he was ready to enter the flow of traffic, would signal the traffic control device 10 with his transmitter 52. The flag would turn a STOP message to the flow of oncoming traffic, and the equipment operator would enter the flow of traffic. He could either activate the traffic control device again to allow the traffic to proceed, or the timer 134 could do so automatically after a preset period of time.

Alternatively, one or more traffic control devices 10 could be set up along a roadway where traffic is to be controlled. This installation would not require interaction with an on-site flagman. If a section of roadway was undergoing construction, and traffic was scheduled to be allowed to pass in one direction on the hour, and in the other direction on the half hour, the two traffic control devices could be configured with a timer to accomplish this automatically and without the intervention of a human operator. If utilized with a video camera, this mode of operation could be modified by an operator who initiated the turning of a sign on one traffic control device 10 when the last vehicle from a string of vehicles admitted by the other traffic control device 10 had passed the second traffic control device 10.

While there is shown and described the present preferred embodiment of the invention, it is to be distinctly understood that this invention is not limited thereto but may be variously embodied to practice within the scope of the following claims.

From the foregoing description, it will be apparent that various changes may be made without departing from the spirit and scope of the invention as defined by the following claims.

I claim:

1. A traffic control device for use with vehicular traffic along a roadway, comprising:

one or more legs, for mounting said traffic control device, configured to resist deflection by wind and to fold to a storage position;

one or more wheels mounted to said legs, which are configured to come into contact with said roadway for transport of said traffic control device, when one end of said traffic control device is lifted by use of a handle;

a handle for lifting one end of said traffic control device, for causing said wheels to engage said roadway;

a simulated flagman mounted to said legs, configured to be observable by a motorist and to attract the attention of a motorist, and configured to move to a storage position;

a sign holder, attached to said simulated flagman, for holding a two-sided traffic control sign, and for rotating said traffic control sign to alternately display a first side or a second side;

a traffic control sign, with a first side and a second side, for alternating display of said first side or said second side, when positioned in said flag holder;

a motor, for attachment to said sign holder, and for rotation of said sign holder;

a weight, attached to said device, for providing said device with stability and resistance to deflection by wind;

a control means for actuating said motor to turn said flag holder, in which said control means is a wireless remote control transmitter and a receiver which can be manually triggered to activate said motor, in order to display said first side or said second side of said traffic control sign; and a power source, which supplies power to said motor and said power control means.

2. The traffic control device of claim 1 which further comprises interchangeable simulated flagmen.

3. The traffic control device of claim 2 in which said interchangeable simulated flagmen are of unusual and attention catching design.

4. The traffic control device of claim 1 in which said control means is a timer which can be set to activate said sign holder at selected time intervals.

5. The traffic control device of claim 1 which further comprises a video camera to view, transmit, and record images of the vicinity of said traffic control device.

6. The traffic control device of claim 1 in which said control means is by a wireless remote transmitter which is energized only while a signal trigger is actuated.

7. The traffic control device of claim 1 which further comprises three legs for mounting said traffic control device.

8. The traffic control device of claim 7 which further comprises a handle attached to said front top corner of said traffic control device, which may be lifted to lift engage said wheels with said roadway.

9. The traffic control device of claim 8 which further includes one or more frame braces which connects said front side of said first planar frame with said front side of said second planar frame, or which connects said rear side of said first planar frame with said rear side of said second planar frame.

10. The traffic control device of claim 1 in which said one or more legs comprises a support frame comprised of a first and a second generally rectangular planar frame, with each rectangular planar frame having a front side, a rear side, a bottom side, and at least one rectangular planar frame having a top side, with each rectangular planar frame having a front bottom corner, a rear bottom corner, a front top corner, and a rear top corner, in which said first and second rectangular planar frames are joined by one or more hinges at said front top corner and said rear top corner, with said bottom sides of said planar frames forming road surface contact regions.

11. The traffic control device of claim 10 which further comprises a first wheel attached to said rear side of said first rectangular planar frame, and a second wheel attached to said rear side of said second rectangular planar frame, with both wheels attached so that when said traffic control device is lifted at one end, said wheels come into contract with said roadway, but when said traffic control device is in an operational position on said roadway, said wheels are not in contact with said roadway.

12. The traffic control device of claim 10 which further comprises four feet which are attached adjacent to said bottom front corners and said bottom rear corners of said first and second rectangular planar frames.

13. The traffic control device of claim 10 in which said first and second rectangular planar frames fold into a traveling configuration by rotating about said one or more hinge so that said bottom edges of said first and second rectangular planar frames approach each other, and which expand into an operational position by rotating about said one or more hinge so that said bottom edges of said first and second rectangular planar frames move away from each other.

14. The traffic control device of claim 1 which further includes a positioning assembly for said flagman which comprises a tube with two orienting notches for positioning the flagman by use of gravity, with one orienting notch resulting in the flagman being positioned with shoulders normal to the longitudinal axis of the traffic control device when in an operational position, and a second orienting notch resulting in the flagman being positioned with shoulders parallel to the longitudinal axis of the traffic control device when in an inverted and transport position.

15. A traffic control device for use with vehicular traffic along a roadway, comprising:

a support frame comprised of a first and a second rectangular planar frame, with each rectangular planar frame having a front side, a rear side, a top side, and a bottom side, with each rectangular planar frame having four corners, and in which said first and second rectangular planar frames are joined by one or more hinges along said top edge of each, in which said first and second rectangular planar frames fold into a traveling configuration by rotating about said one or more hinge so that said bottom edges of said first and second rectangular planar frames approach each other, and which fold into an operational position by rotating about said one or more hinges so that said bottom edges of said first and second rectangular planar frames move away from each other, with said bottom sides of said planar frames forming road surface contact regions which resists movement of said traffic control device by wind;

one or more end braces which connects said front side of said first planar frame with said front side of said second planar frame, or which connects said rear side of said first planar frame with said rear side of said second planar frame, and which lock said traffic control device into an operational position when so connected, and allow said traffic control device to fold into a transport and storage position;

one or more wheels attached to said support frame, attached so that when said traffic control device is lifted at one end, said one or more wheels come into contract with said roadway, but when said traffic control device is in an operational position on said roadway, said one or more wheels are not in contact with said roadway;

a handle attached to said traffic control device, which may be lifted to engage said wheels with said roadway, and to disengage said bottom sides from said roadway which enable said traffic control device to be transported on a roadway of gravel or pavement on said wheels when in either a transport position or an operational position;

a simulated flagman mounted to said support frame, configured to be observable and to attract the attention of a motorist, which folds two times, once in one plane and once in another plane, to a storage position for transport;

a positioning assembly for said flagman which comprises a gripping collar with two stop rings, with a detent notch in one stop ring which interfits with a detent tab on said gripping collar, and which also comprises a flagman tube with two orienting notches for positioning the flagman by use of gravity, with one orienting notch resulting in the flagman being positioned with shoulders normal to the longitudinal axis of the traffic control device when in an operational position, and a second orienting notch resulting in the flagman being positioned with shoulders parallel to the longitudinal axis of the traffic control device when in an inverted and transport position;

a sign holder attached to said simulated flagman, for holding a two-sided traffic control sign, and for rotating said traffic control sign to alternately display a first side or a second side of said two-sided traffic control sign;

a motor, for turning said sign holder;

a two-sided traffic control sign, with a first side and a second side for alternating display of said first or said second side, when positioned in said sign holder;

one or more weights, attachable to and detachable from said device without use of tools, for providing said device with stability and resistance to deflection by wind;

a wireless remote control means comprising a transmitter, a signal trigger, and a receiver, for remotely actuating said motor to rotate said flag, and causing said flag holder to rotate said traffic control sign to display a first side or a second side of said sign; and a power source, which supplies power to said flag holder.

* * * * *